US008201296B2

(12) United States Patent
Mayer

(10) Patent No.: US 8,201,296 B2
(45) Date of Patent: Jun. 19, 2012

(54) FLOOR TREATMENT CLEANING SYSTEMS

(75) Inventor: Heinrich-Tito Mayer, Eschlikon (CH)

(73) Assignee: Diversey, Inc., Sturtevant, WI (US)

( * ) Notice: Subject to any disclaimer, the term of this patent is extended or adjusted under 35 U.S.C. 154(b) by 904 days.

(21) Appl. No.: 11/568,680

(22) PCT Filed: Apr. 27, 2005

(86) PCT No.: PCT/US2005/014470

§ 371 (c)(1),
(2), (4) Date: Oct. 16, 2008

(87) PCT Pub. No.: WO2005/112729

PCT Pub. Date: Dec. 1, 2005

(65) Prior Publication Data

US 2009/0139554 A1 Jun. 4, 2009

(30) Foreign Application Priority Data

May 7, 2004 (EP) ..... 04010927

(51) Int. Cl.
*A47L 11/283* (2006.01)
*A47L 11/284* (2006.01)
*A47L 11/294* (2006.01)

(52) U.S. Cl. ..... 15/49.1; 15/50.1; 15/79.2; 15/81; 15/98

(58) Field of Classification Search ..... 15/49.1, 15/78, 79.2, 80, 81, 98, 50.1
See application file for complete search history.

(56) References Cited

U.S. PATENT DOCUMENTS

| | | | | |
|---|---|---|---|---|
| 1,417,673 | A * | 5/1922 | Lipscomb | 15/49.1 |
| 2,247,993 | A | 7/1941 | Fisker | |
| 2,545,942 | A | 3/1951 | Zasadny et al. | |
| 2003/0172480 | A1 * | 9/2003 | Ueda et al. | 15/98 |

FOREIGN PATENT DOCUMENTS

| | | |
|---|---|---|
| BE | 376229 | 1/1931 |
| EP | 1344484 | 9/2003 |
| GB | 19761 | 0/1913 |

(Continued)

OTHER PUBLICATIONS

The European Search Report and the International Search Report, Jun. 2005.

*Primary Examiner* — Randall Chin
(74) *Attorney, Agent, or Firm* — Gregory S. Bollis

(57) ABSTRACT

Floor treatment cleaning system (3) for a floor cleaning machine (1). The floor treatment cleaning system includes at least two treatment elements (7*a*, 7*b*) wherein each treatment element is equipped with cleaning means (11) and is eccentrically driven by driving means (15A) via at least two synchronized eccentric pivots (8), characterized in that the respective pivots revolve around their main rotation axes (13) in such a way that the at least two treatment elements perform opposite movements thereby transporting residues on the floor in a desired direction and balancing engine masses and friction. The treatment elements (7*a*, 7*b*) can be positioned in different ways: transversely relative to the moving direction of the machine (1) and parallel behind each other, transversely relative to the moving direction of the machine (1) and next to each other and in a V-shape or arcuate with the opening in the moving direction of the machine.

11 Claims, 8 Drawing Sheets

FOREIGN PATENT DOCUMENTS

| | | |
|---|---|---|
| GB | 516405 | 10/1937 |
| GB | 1090365 | 2/1966 |
| GB | 2086216 | 5/1982 |
| JP | H05-245088 | 9/1993 |
| JP | H07-39506 | 2/1995 |
| JP | H09-299298 | 11/1997 |
| JP | 2003190064 | 7/2003 |
| JP | 2003-265384 | 9/2003 |

* cited by examiner

FLOOR TREATMENT CLEANING SYSTEMS

TECHNICAL FIELD

The present invention relates to a floor treatment cleaning system.

BACKGROUND AND STATE OF THE ART

Various systems for cleaning floor surfaces are known. At present, the two most common systems on the market are disc systems and cylindrical systems. Disc systems comprise a flat disc being fitted with brushes or pads which is rotated around an axis perpendicular to the surface plane. Having the advantage of a large contact area with the floor and being very flexible concerning the adaptation to different cleaning tasks due to a variety of pad/brush configurations, disc systems have the following drawbacks, though. Firstly, tool pressure and tool diameter are limited: the maximum tool pressure is defined by the machine weight minus the necessary weight for sufficient traction and in some cases also by pressure needs due to the suction system; the diameter is limited by the effect of centrifugal forces. Furthermore, the drive performance of the motor increases with the pressure—this influences motor size, costs and machine autonomy: for many cleaning purposes, a high weight is needed which results in a high power consumption. Finally, disc systems show different agitation directions at different points of the working area as well as changing agitation parameters with increased moving speed of the machine: at higher speed, the moving speed is added on one side of the disc, whereas it is substracted on the other side such that the relative speed can even be zero in some areas.

Cylindrical systems comprise a cylindrical brush which is rotated around an axis parallel to the surface plane. In contrast to disc systems, cylindrical systems have constant agitation parameters over the full cleaning area and a high specific brush pressure due to the cylindrical brush being rotated around an axis parallel to the floor. However, cylindrical systems have other drawbacks. Firstly, the tools are very expensive and have a highly restricted versatility. Secondly, the contact area with the floor is very small: thus, at a higher moving speed of the machine, the agitation time becomes very short. Furthermore, the relative cleaning speed of the bristles can be zero over the whole length of the tool and the overall cleaning result is worse. Finally, cylindrical systems have a high power consumption.

Another system for cleaning surfaces makes use of the principle of a vibrating sander. GB 1 090 365, 2 086 216 and 2 280 843 disclose floor cleaning, scrubbing or polishing devices wherein cleaning means—brushes, pads or the like—is fixed to the underside of a vibrating plate which undergoes a horizontal vibration movement. The plate is attached to an upper stationary frame via flexible connecting members on its upper side, and the horizontal vibration movement is achieved by the rotation of an eccentric vertical drive shaft. Although the cleaning means according to this system have a large contact area with the floor and constant agitation parameters almost over the full cleaning area, they undergo a randomly vibrating movement which does not provide for an efficient transportation of dirt and cleaning solution in a determined direction.

GB 516 405 discloses a machine for grinding or polishing surfaces. As in the last mentioned systems using the vibrating sander principle, an eccentric movement of vertical shafts is utilized to create a horizontal circular movement of working implements. However, instead of being connected to a stationary frame via resilient members and being vibrated around a single eccentric shaft, several working implements are driven in a circular translatory motion each by a plurality of driving crank members. By arranging the cranks opposed in respect of two implements of a pair, but rotating the implements of this pair in the same rotation direction, the implements are moved in such a manner that they cooperate two by two such that each pair will neutralize the forces deriving from the movements. However, since GB 516 405 is concerned with polishing or grinding an already clean surface and not with cleaning it from dirt, it is not disclosed how the dirt is actually removed.

SUMMARY OF THE INVENTION

It is thus an object of the present invention to provide a floor treatment cleaning system which combines the advantages of the different prior art systems without being subject to their problems.

This is achieved by a floor treatment cleaning system with apparatus which utilizes an eccentrical drive for a rotational non-vibrating movement of the treatment elements in order to achieve a uniform cleaning result over a large working area and an efficient transportation of dirt and cleaning solution in a determined direction with less power consumption.

According to the present invention, the floor treatment cleaning system comprises at least two treatment elements wherein each treatment element is equipped with cleaning means and is eccentrically driven by driving means via least two synchronized eccentric pivots, characterized in that the respective pivots revolve around their main rotation axes in such a way that the at least two treatment elements perform opposite movements thereby transporting residues on the floor in a desired direction and balancing engine masses and friction.

DESCRIPTION OF THE PREFERRED EMBODIMENTS

Figure 1:
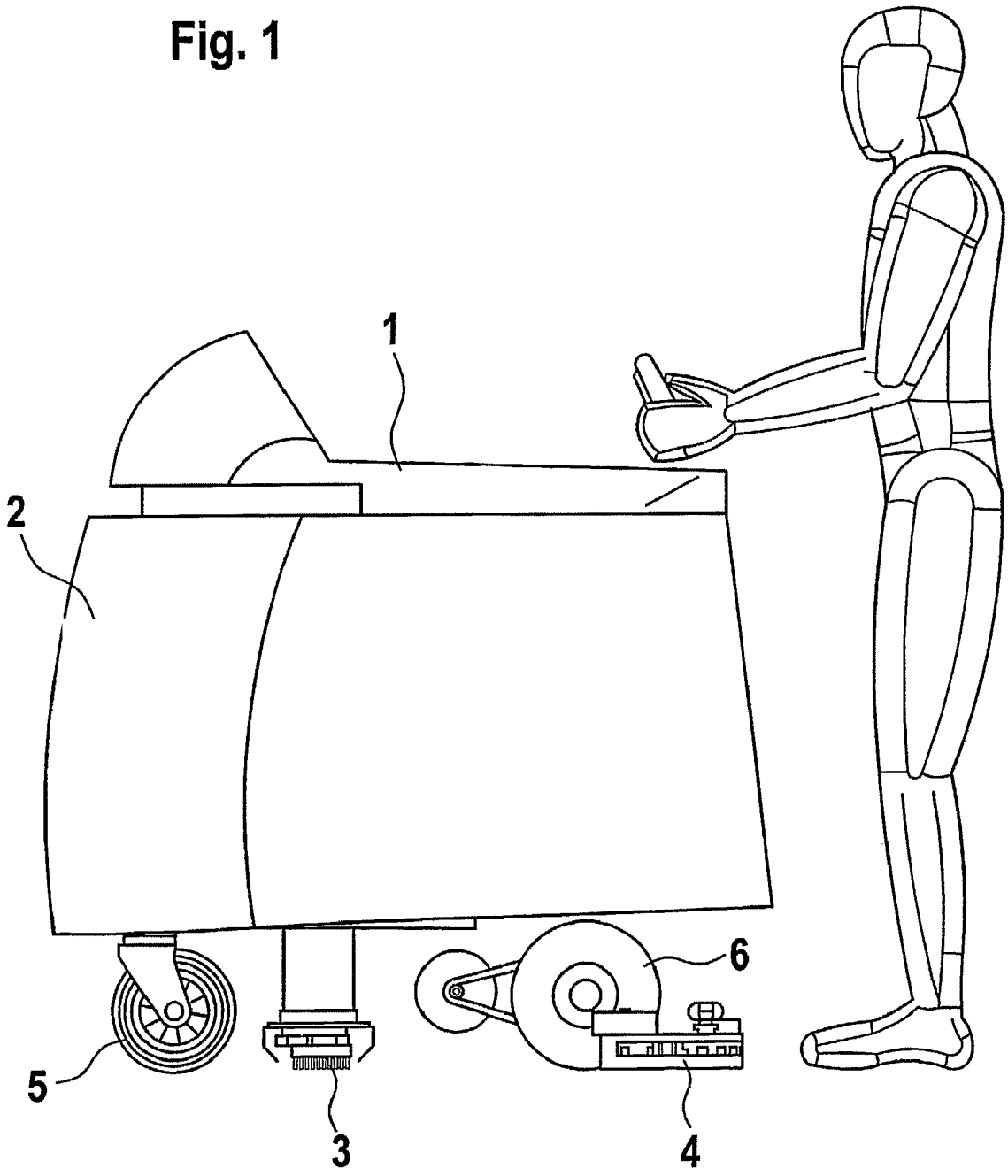
FIG. 1 shows a side view of a floor cleaning machine which is equipped with a floor treatment cleaning system according to a first embodiment of the present invention using two transversal treatment elements arranged behind each other.
Figure 2:
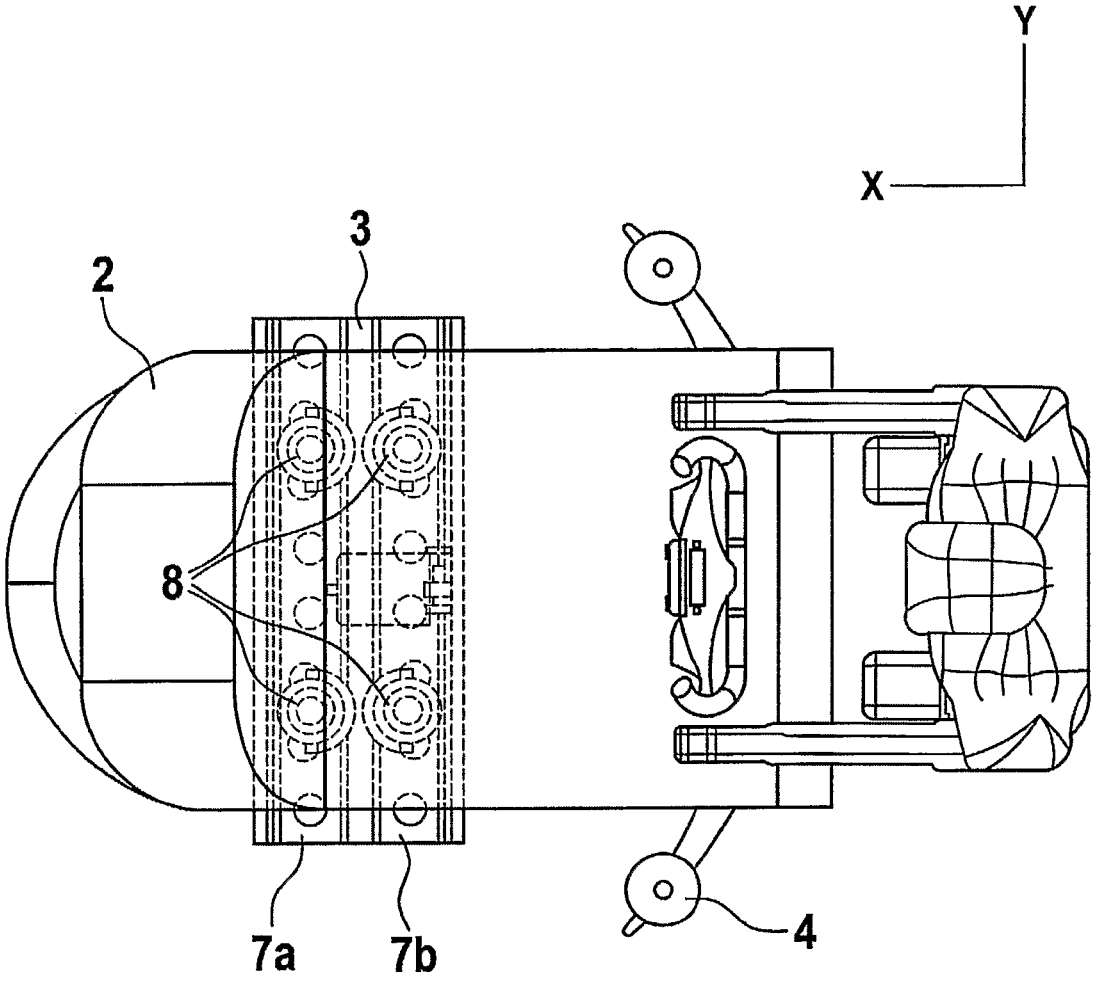
FIG. 2 shows a top view of the machine of FIG. 1.

FIGS. 1 and 2 illustrate a cleaning machine which is equipped with a floor treatment cleaning system according to the present invention. The floor cleaning machine 1 comprises a tank 2, a floor treatment cleaning system 3 and a suction foot (squeegee) 4 behind the treatment cleaning system. The machine runs on a front wheel 5 and two rear wheels 6. According to the first embodiment, the floor treatment cleaning system comprises two treatment elements 7*a* and 7*b* which are arranged transversely relative to the moving direction of the machine 1 and in parallel behind each other (as can be seen in more detail in FIG. 2). The elements are each driven by two eccentric pivots 8.

Figure 3:
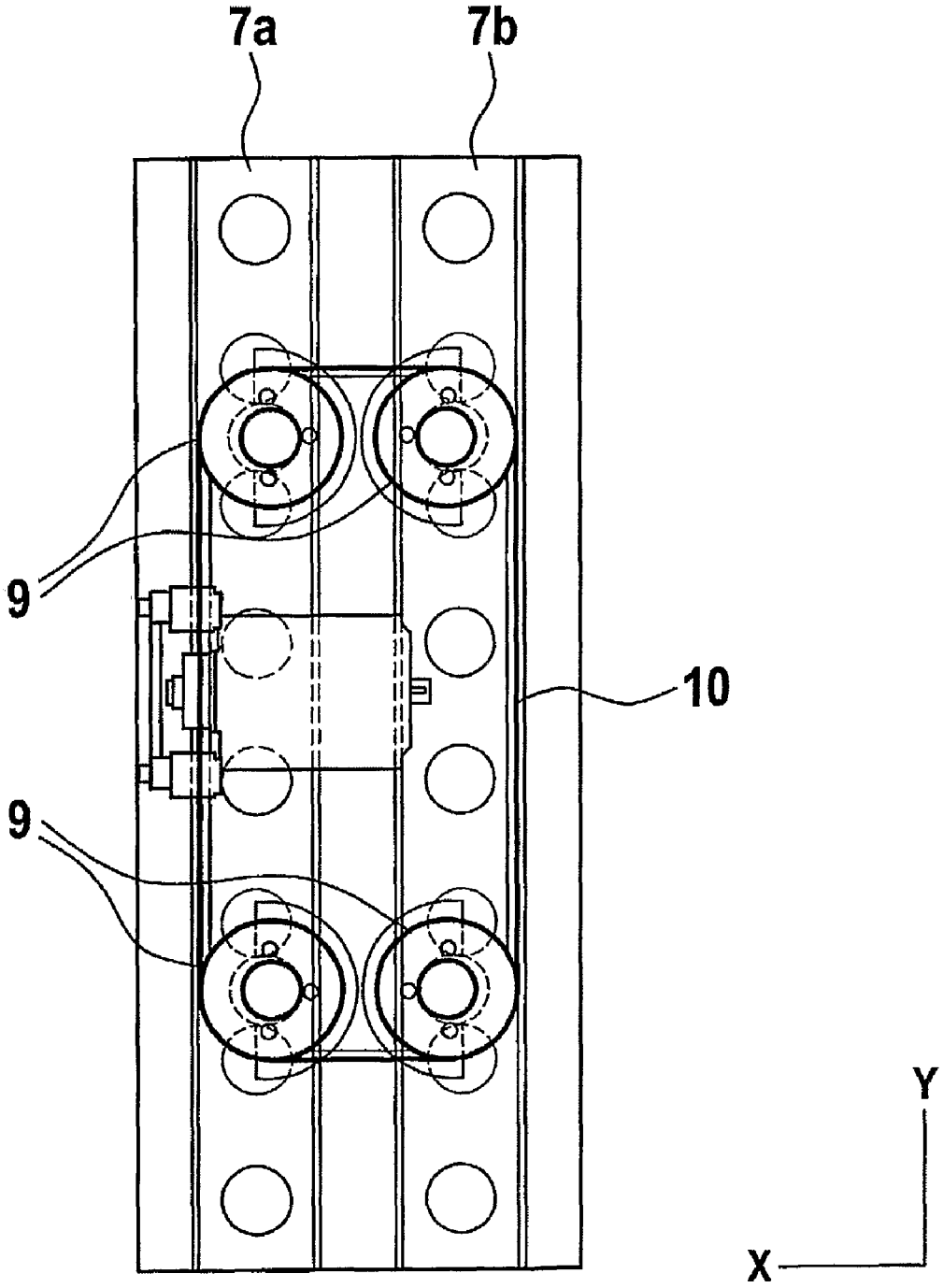
FIG. 3 shows a top view of the floor treatment cleaning system of FIG. 1.

FIG. 3 shows that the two eccentrically driven treatment elements 7*a* and 7*b* are interconnected via four synchronization pulleys 9 and a system synchronization belt 10. As can be seen, the treatment elements 7*a*, 7*b* are arranged with a phase shift of 180°, i.e., the pivots of treatment element 7*a* and the pivots of treatment element 7*b* are located in opposite positions relative to their respective main rotational axes around which they revolve. For example, as can be seen in FIG. 3, the pivots of treatment element 7*a* are positioned to the right of their main rotational axes, whereas the pivots of treatment element 7*b* are positioned to the left of their main rotational axes. In operation, all pivots revolve in the same rotation direction around their respective main axes and, thus, the treatment elements 7*a* and 7*b* perform the same constrained rotation. But due to the 180° phase shift, the treatment elements 7*a* and 7*b* always perform opposite movements relative to the moving direction of the machine and the direction transversal thereto (indicated by x and y in FIGS. 2 and 3).

In this way, residues on the floor will be transported in a determined direction. Due to its rotational direction, the oscillating rotational movement of the treatment elements advances residues on the floor in a direction which equals the direction of the peripheral speed of the front edge of the treatment element (seen in the moving direction of the machine). For example, if the pivots 8 rotate clockwise around their main rotational axes, residues on the floor will be transported to the right, i.e., along the y-direction, seen in the moving direction x of the machine in FIG. 2. Besides this controlled transportation of residues on the floor, the opposite movements of the treatment elements also result in a balancing of engine masses as well as in a compensation of friction.

This opposite movement of the two treatment elements in both the x and y directions in FIG. 3 is one example of what is called "opposite movements" of the treatment elements in this description—further examples of such opposite movements will follow in connection with other embodiments of the present invention.

Figure 4:
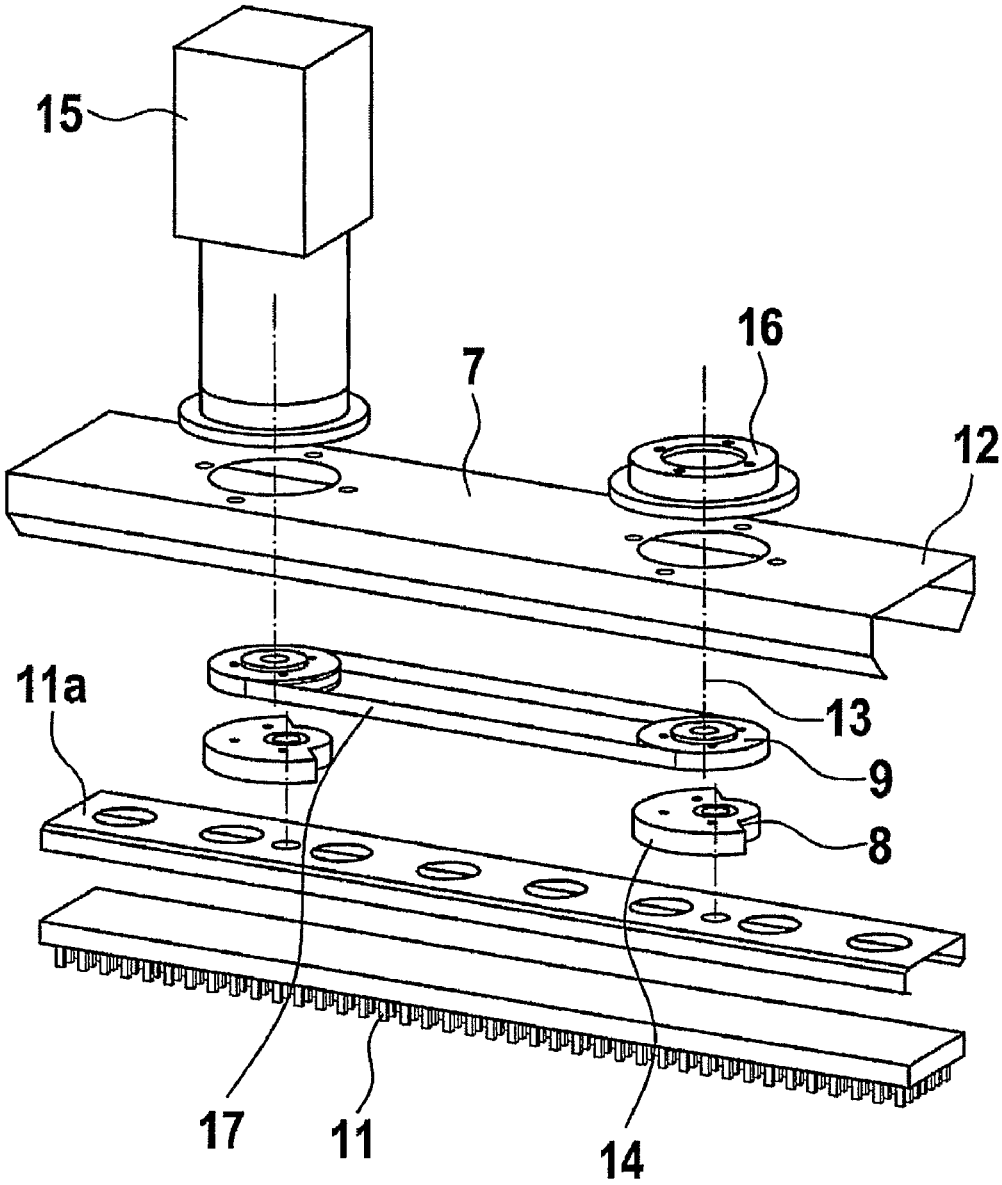
FIG. 4 shows an oblique view of one treatment element of the floor treatment cleaning system according to the present invention.

FIG. 4 shows the features of a treatment element 7 in more detail. A brush 11 is attached to a holding element 11*a*, wherein brush 11 and holding element 11*a* are enclosed from above by a frame 12 which provides enough space for a constrained horizontal rotation movement of brush holding 11*a* element therein—this movement will be discussed in further detail below. Frame 12 is provided with two bearing elements 16 which are spaced apart and underneath each bearing element 16, a pulley 9 is provided for rotational movement around its respective main shaft 13. The pulleys are fixedly connected to their respective rotation shafts in a manner known per se. A balancing mass 14 is concentrically flange mounted to each pulley 9. Alternatively, pulley 9 and balancing mass 14 can be made of one piece. Underneath each balancing mass 14, an eccentrical pivot 8 is provided which is rotatably connected to brush holding element 11*a*. Thus, brush holding element 11*a* is supported by two eccentrical pivots 8 which are rotatably connected thereto and which have a certain distance between them. For a constrained rotation movement of brush holding element 11*a*, the two pulleys 9 are interconnected via an element synchronization belt 17. It should be noted that element synchronization belt 17 of FIG. 4 leads to a restricted guidance of a single treatment element, whereas the synchronization of the whole treatment system, i.e., the two treatment elements as described in connection with FIG. 3, is achieved by system synchronization belt 10.

The operation of the treatment element 7 is as follows. Main shaft 13 of one of the pulley/pivot assemblies is rotatably driven by driving means 15 as depicted in FIG. 4. Alternatively, instead of driving one of the main shafts directly, element synchronization belt 17 can be driven. Since the two rotating pivots 8 are synchronized via pulleys 9 and element synchronization belt 17 as explained above, they perform the same rotation around their respective main shafts 13. Due to the fact that brush holding element 11*a* is rotatably connected to the two synchronized pivots 8 which revolve around their respective main shafts 13, brush 11 which is mounted underneath holding element 11*a* performs a constrained rotation on the floor. It is of special importance that there is a certain distance between the two eccentrical pivots 8 which are connected to the holding element 11*a* such that a stable constrained rotation movement thereof is achieved. It is noted that the balancing masses 14 add to the balancing of engine masses as mentioned above in connection with the opposite movements of the treatment elements 7*a*, 7*b*. Driving means 15 can be equipped with speed regulation means (not shown) in order to adapt the rotation speed of the treatment elements to individual needs such as machine speed, machine type or degree of soiling.

Figure 5:
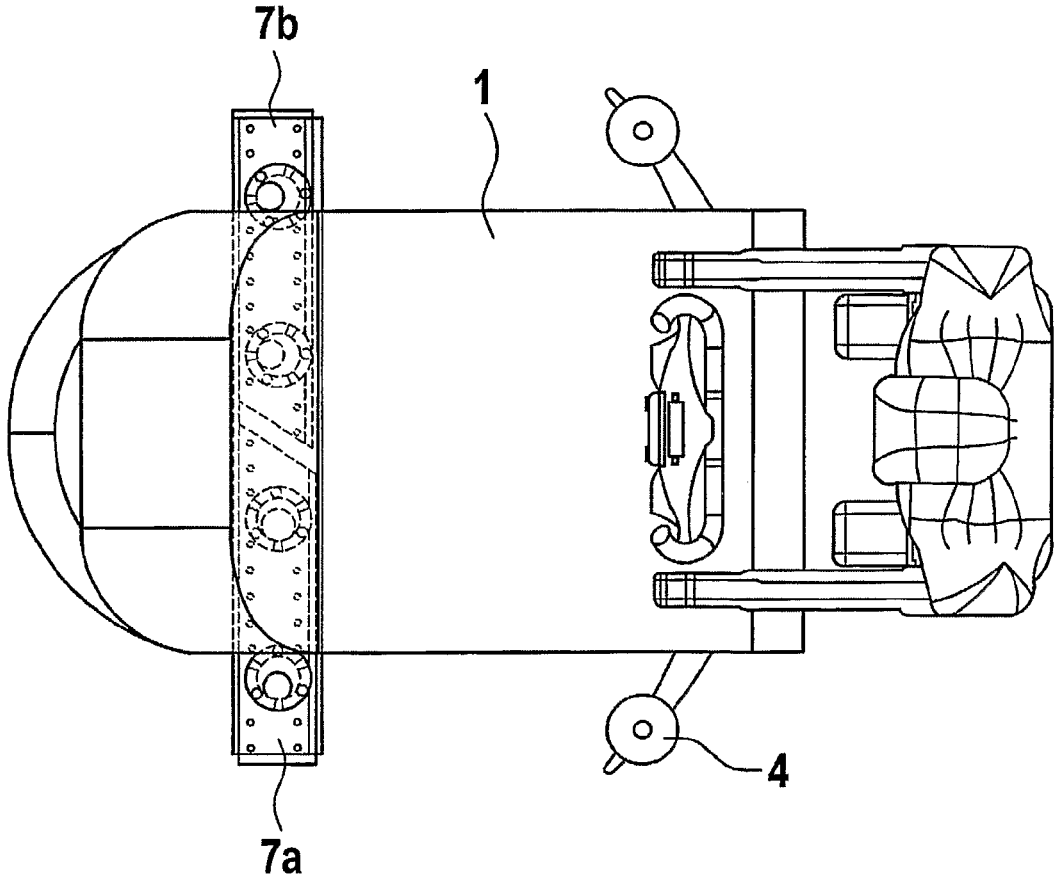
FIG. 5 shows a top view of a floor cleaning machine which is equipped with a floor treatment cleaning system according to a second embodiment of the present invention using two transversal treatment elements arranged next to each other.

FIG. 5 shows a top view of a floor cleaning machine which is equipped with a second embodiment of the floor treatment cleaning system according to the present invention. As in the first embodiment of FIGS. 1-3, the two treatment elements 7*a* and 7*b* are arranged transversely relative to the moving direction of the machine 1 but next to each other instead of behind each other. The inner edges of the treatment elements are chamfered. In operation, the left treatment element 7*a* relative to the moving direction of the machine is driven to perform a clockwise constrained rotation, whereas the right treatment element 7*b* is driven to perform a counterclockwise constrained rotation. In this way, the two treatment elements perform opposite constrained rotation movements, and residues on the floor will be transported to the center of the cleaning machine such that they can be picked up by squeegee 4. The treatment elements are synchronized by a synchronization belt (not shown) with a 0° or 180° phase shift for balancing of engine masses and compensation of friction. In this embodiment, the "opposite movements" of the treatment elements result from being rotated in opposite directions—in contrast to the first embodiment, where the rotation directions were the same but the movements in the x and y directions were opposed.

Figure 6:
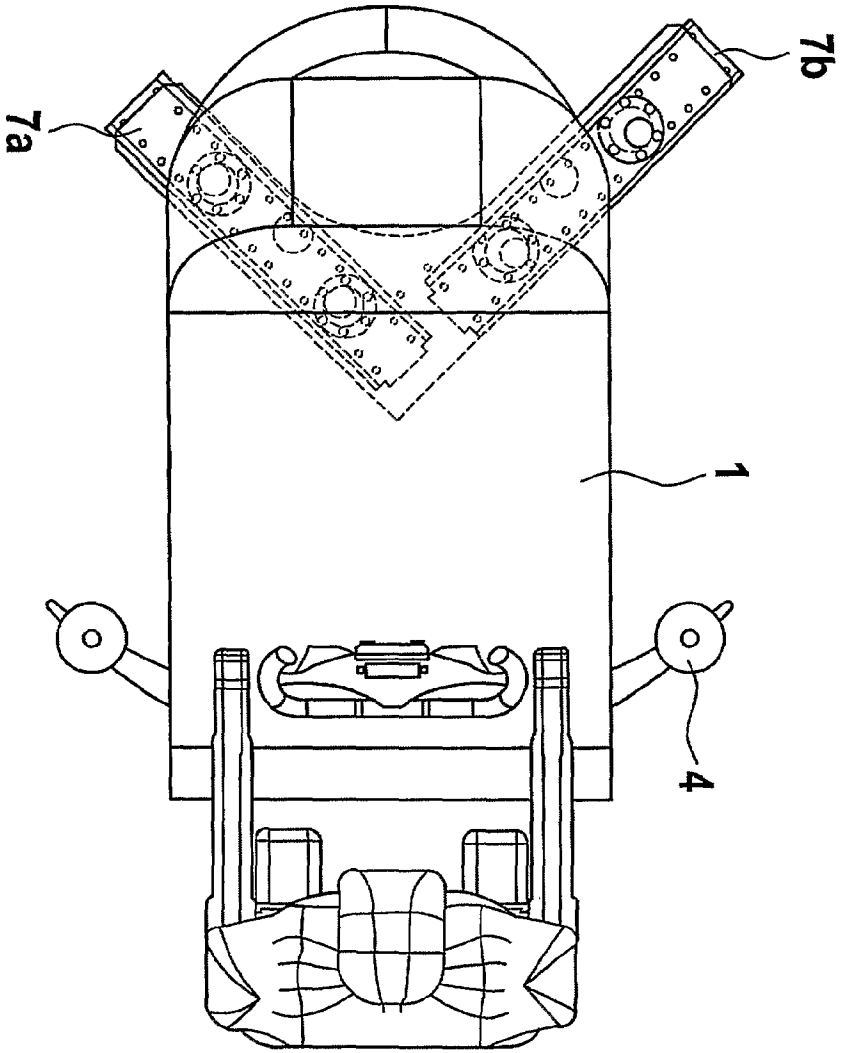
FIG. 6 shows a top view of a floor cleaning machine which is equipped with a floor treatment cleaning system according to a third embodiment of the present invention using two oblique treatment elements arranged in a V-shape.

FIG. 6 shows a top view of a floor cleaning machine which is equipped with a third embodiment of the floor treatment cleaning system according to the present invention. In this embodiment, the two treatment elements 7*a* and 7*b* are arranged in a V-shape with the opening in the moving direction of the machine 1. The operation is similar to the one of the second embodiment, i.e., the left treatment element 7*a* is driven to perform a clockwise constrained rotation, whereas the right treatment element 7*b* is driven to perform a counterclockwise constrained rotation such that residues on the floor will be transported to the center of the cleaning machine where they can be picked up by squeegee 4. As in the second embodiment, the treatment elements are synchronized with a 0° or 180° phase shift for balancing of engine masses and compensation of friction. As before, the "opposite movements" of the treatment elements result from being rotated in opposite directions.

Figure 7:
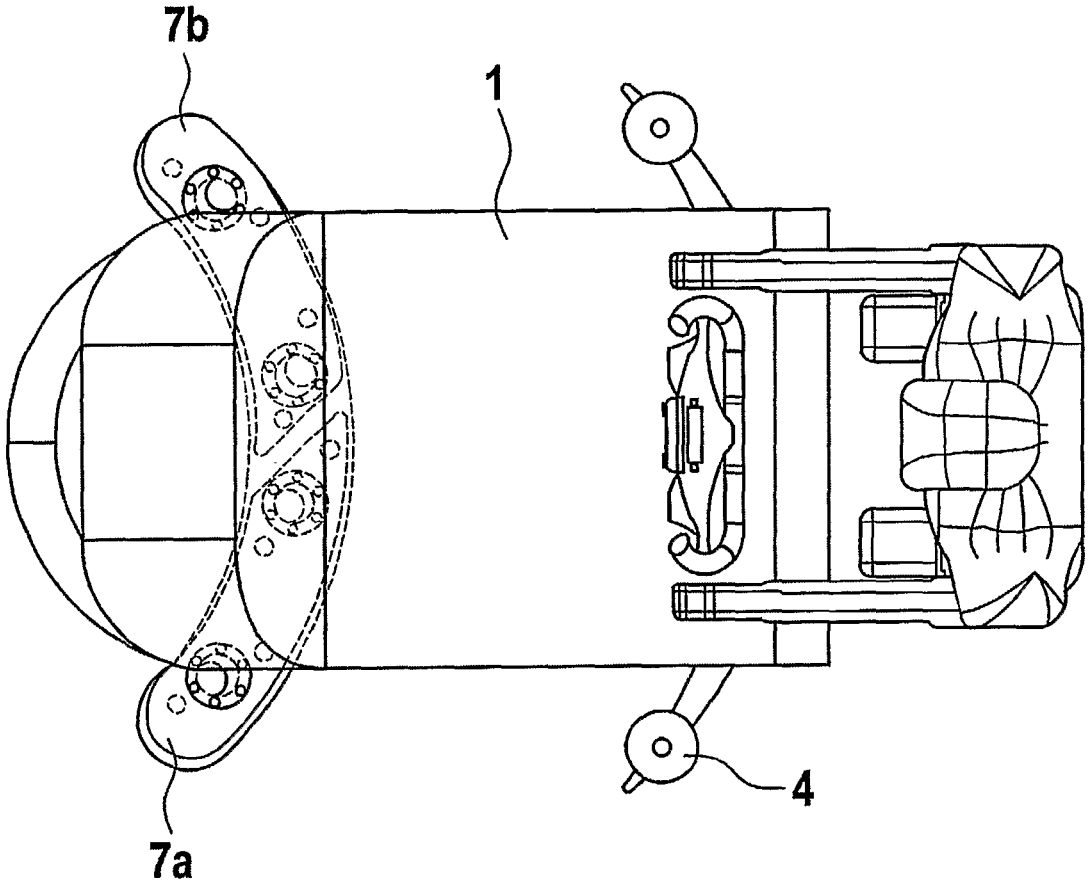
FIG. 7 shows a top view of a floor cleaning machine which is equipped with a floor treatment cleaning system according to a fourth embodiment of the present invention using two arcuate treatment elements arranged next to each other and forming a circle segment.

FIG. 7 shows a top view of a floor cleaning machine which is equipped with a fourth embodiment of the floor treatment cleaning system according to the present invention. This embodiment is similar to the second and third, except for the treatment elements being arcuate.

Figure 8:
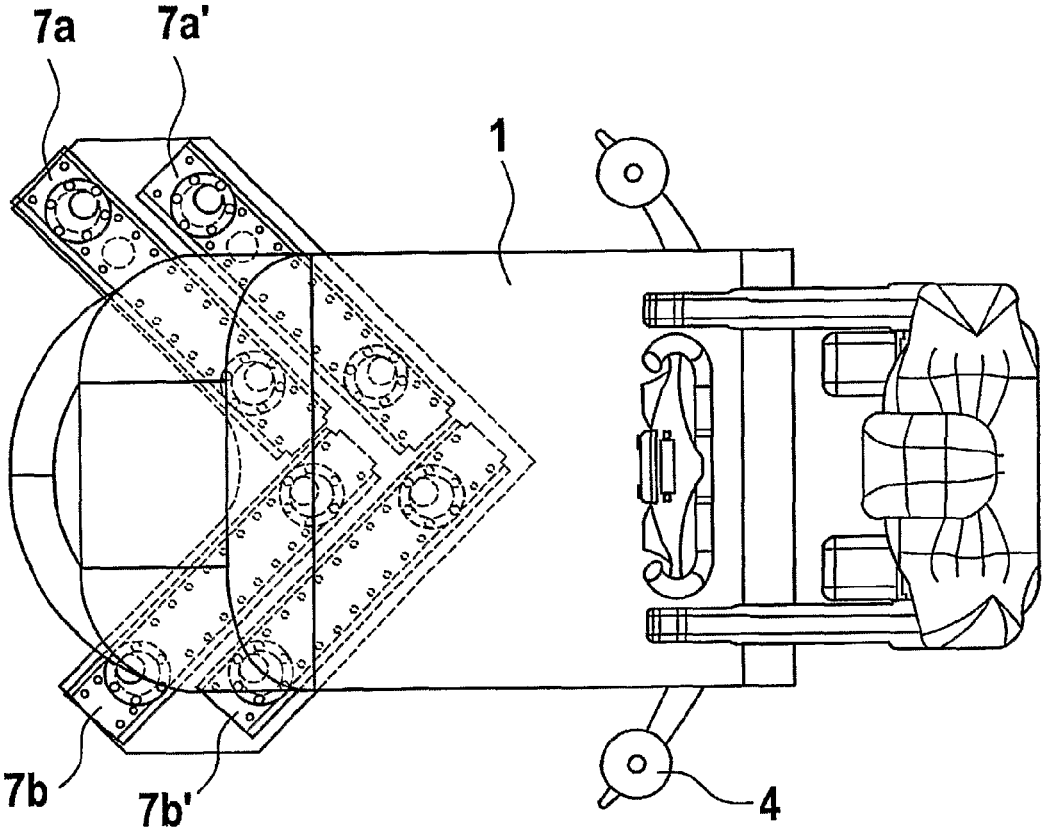
FIG. 8 shows a top view of a floor cleaning machine which is equipped with a floor treatment cleaning system according to a fifth embodiment of the present invention using four oblique treatment elements arranged in a V-shape.

FIG. 8 shows a top view of a floor cleaning machine which is equipped with a fifth embodiment of the floor treatment cleaning system according to the present invention. In this embodiment (which can be considered as a combination of the first and third embodiments), two sets each consisting of two treatment elements 7*a*, 7*a*' and 7*b*, 7*b*', resp., are arranged in a V-shape with the opening in the moving direction of the machine. In operation, the left treatment elements 7*a*, 7*a*' relative the moving direction of the machine are driven to perform a clockwise constrained rotation, whereas the right treatment elements 7*b*, 7*b*' are driven to perform a counterclockwise constrained rotation. The treatment elements of each set are synchronized with a 180° phase shift as in the first embodiment, for example, via pulleys 9 and a belt 10 (see FIG. 3). Again, residues on the floor will be transported to the center of the cleaning machine such that they can be picked up by squeegee 4. Due to the 180° phase shift between the treatment elements of each set, a balancing of engine masses and compensation of friction is obtained. However, in order to avoid collisions between the left and right set of treatment elements, a synchronization between the two sets as in the second embodiment can be advantageous.

It is emphasized that the different embodiments of the present invention as mentioned above describe the invention by way of example only. Various alternatives are also in the scope of the present invention as defined in the appended claims. For example, various other arrangements of the treatment elements relative to the machine are possible as well as different shapes of the elements. Furthermore, the system and element synchronization means can be modified, for example, the belts 10 and 17 can be replaced by a chain or by con-rods. The cleaning machine itself can also be modified, for example, the treatment cleaning system could also be positioned in front of the front wheel 5, the squeegee 4 could be positioned in front of the rear wheels 6, other wheels could be provided etc.

The invention claimed is:

1. Floor treatment cleaning system for a floor cleaning machine, comprising two treatment elements wherein each treatment element is equipped with cleaning means and wherein each treatment element is eccentrically driven by driving means via two synchronized eccentric pivots having main rotation axes, characterized in that the respective pivots revolve around their main rotation axes in such a way that the two treatment elements perform opposite rotational movements thereby transporting residues on the floor in a desired direction and balancing engine masses and friction, further characterized in that the two treatment elements are arranged in a V-shape with an opening in the moving direction of the machine, wherein a left treatment element of the two treatment elements relative to the moving direction of the machine is driven to perform a clockwise constrained rotation and a right treatment element of the two treatment elements is driven to perform a counterclockwise constrained rotation such that the two treatment elements perform opposite constrained rotation movements.

2. Floor treatment cleaning system for a floor cleaning machine, comprising two treatment elements wherein each treatment element is equipped with cleaning means and wherein each treatment element is eccentrically driven by driving means via two synchronized eccentric pivots having main rotation axes, characterized in that the respective pivots revolve around their main rotation axes in such a way that the two treatment elements perform opposite rotational movements thereby transporting residues on the floor in a desired direction and balancing engine masses and friction, further characterized in that the two treatment elements are arranged transversely relative to the moving direction of the machine and next to each other to define a left treatment element and a right treatment element, wherein the left treatment element relative to the moving direction of the machine is driven to perform a clockwise constrained rotation and the right treatment element is driven to perform a counterclockwise constrained rotation such that the two treatment elements perform opposite constrained rotation movements.

3. Floor treatment cleaning system according to claim 2, characterized in that the treatment elements are synchronized with a phase shift of 0°.

4. Floor treatment cleaning system according to claim 2, characterized in that the treatment elements are synchronized with a phase shift of 180°.

5. Floor treatment cleaning system according to claim 2, characterized in that the treatment elements are arcuate.

6. Floor treatment cleaning system for a floor cleaning machine, comprising two treatment elements wherein each treatment element is equipped with cleaning means and wherein each treatment element is eccentrically driven by driving means via two synchronized eccentric pivots having main rotation axes, characterized in that the respective pivots revolve around their main rotation axes in such a way that the two treatment elements perform opposite rotational movements thereby transporting residues on the floor in a desired direction and balancing engine masses and friction, further characterized in that two sets each consisting of the two treatment elements, respectively, are arranged in a V-shape with an opening in the moving direction of the machine to define a left set of treatment elements and a right set of treatment elements, wherein the treatment elements of each set are interconnected via synchronization means such that the treatment elements of each set perform the same constrained rotation movement and wherein the treatment elements of the left set relative to the moving direction of the machine are driven to perform a clockwise constrained rotation and the right treatment elements of the right set are driven to perform a counterclockwise constrained rotation such that the two sets of treatment elements perform opposite constrained rotation movements.

7. Floor treatment cleaning system according to claim 6, characterized in that the treatment elements of each set are synchronized with a 180° phase shift such that the they perform opposite movements relative to the moving direction of the machine and the direction transversal thereto.

8. Floor treatment cleaning system according to claim 6, characterized in that the left and right sets of treatment elements are synchronized.

9. Floor treatment cleaning system according to claim 6, characterized in that each set of treatment elements is connected to the driving means by a main shaft, and wherein each main shaft is provided with a balancing mass for balancing of engine masses.

10. Floor treatment cleaning system according to claim 6, characterized in that the driving means is equipped with speed regulation means in order to adapt the rotation speed of the treatment elements to at least one of machine speed, machine type or degree of soiling.

11. A floor treatment cleaning system for a floor cleaning machine, comprising two treatment elements wherein each treatment element is equipped with a brush and wherein each treatment element is eccentrically driven by driving means via two synchronized eccentric pivots having main rotation axes, characterized in that the respective pivots revolve around their main rotation axes in such a way that the two treatment elements perform opposite rotational movements thereby transporting residues on the floor in a desired direction and balancing engine masses and friction, further characterized in that the two treatment elements are arranged transversely relative to the moving direction of the machine and next to each other to define a left treatment element and a right treatment element, wherein the left treatment element relative to the moving direction of the machine is driven to perform a clockwise constrained rotation and the right treatment element is driven to perform a counterclockwise constrained rotation such that the two treatment elements perform opposite constrained rotation movements.

* * * * *